US010407261B2

(12) United States Patent
Tsukasaki

(10) Patent No.: US 10,407,261 B2
(45) Date of Patent: Sep. 10, 2019

(54) PAPER FEEDING APPARATUS

(71) Applicant: Masahiro Tsukasaki, Osaka (JP)

(72) Inventor: Masahiro Tsukasaki, Osaka (JP)

( * ) Notice: Subject to any disclaimer, the term of this patent is extended or adjusted under 35 U.S.C. 154(b) by 67 days.

(21) Appl. No.: 15/430,873

(22) Filed: Feb. 13, 2017

(65) Prior Publication Data

US 2017/0152117 A1 Jun. 1, 2017

Related U.S. Application Data

(63) Continuation of application No. PCT/JP2015/073645, filed on Aug. 24, 2015.

(30) Foreign Application Priority Data

Aug. 29, 2014 (JP) ..... 2014-175209

(51) Int. Cl.

| | |
|---|---|
| ***B65H 3/06*** | (2006.01) |
| ***B65H 3/56*** | (2006.01) |
| ***B65H 3/08*** | (2006.01) |
| ***B65H 7/18*** | (2006.01) |

(52) U.S. Cl.

CPC ..... *B65H 3/0692* (2013.01); *B65H 3/063* (2013.01); *B65H 3/0669* (2013.01); *B65H 3/085* (2013.01); *B65H 3/56* (2013.01); *B65H 7/18* (2013.01); *B65H 2404/15421* (2013.01); *B65H 2511/51* (2013.01); *B65H 2511/515* (2013.01); *B65H 2513/11* (2013.01); *B65H 2513/20* (2013.01);

(Continued)

(58) Field of Classification Search

CPC ..... B65H 3/12; B65H 3/0692; B65H 3/063; B65H 3/085; B65H 3/122; B65H 3/126

See application file for complete search history.

(56) References Cited

U.S. PATENT DOCUMENTS 5,006,042 A * 4/1991 Park ..... B65H 3/063 198/577
5,074,539 A * 12/1991 Wells ..... B65H 3/042 271/12
5,722,652 A 3/1998 Yoshida et al.

(Continued)

FOREIGN PATENT DOCUMENTS

GB 2 137 178 10/1984
JP 61-295936 12/1986

(Continued)

OTHER PUBLICATIONS

International Search Report dated Nov. 2, 2015 in International (PCT) Application No. PCT/JP2015/073645.

*Primary Examiner* — Thomas A Morrison
(74) *Attorney, Agent, or Firm* — Wenderoth, Lind & Ponack, L.L.P.

(57) ABSTRACT

In a paper feeding apparatus, paper feed rolls in paper feed roll rows for feeding the lowermost one of cardboard sheets placed in a stacked manner on a paper feeding table intermittently one by one toward the printing device are coupled via shafts to separate servomotors. The servomotors are controlled so to be accelerated synchronously and rapidly from a stopped state to a high rotational speed during one cycle of feeding through contact with the lowermost cardboard sheet, while controlled so to be decelerated from the high rotational speed to be stopped rapidly and respectively when determined not to be in contact with the lowermost cardboard sheet.

3 Claims, 7 Drawing Sheets

(52) U.S. Cl.
CPC ..... *B65H 2553/51* (2013.01); *B65H 2555/24* (2013.01); *B65H 2701/176* (2013.01)

(56) References Cited

U.S. PATENT DOCUMENTS 6,543,760 B1 * 4/2003 Andren ..... B65H 3/063 271/112
7,621,524 B2 * 11/2009 Levin ..... B65H 3/063 271/112

FOREIGN PATENT DOCUMENTS

| | | |
|---|---|---|
| JP | 63-282033 | 11/1988 |
| JP | 7-117879 | 5/1995 |
| JP | 2726516 | 12/1997 |
| JP | 11-106071 | 4/1999 |
| JP | 2009-120400 | 6/2009 |
| JP | 2013-112465 | 6/2013 |

* cited by examiner

PAPER FEEDING APPARATUS

CROSS REFERENCE TO RELATED APPLICATIONS

This application is a continuation of International Application PCT/JP2015/073645 filed on 24 Aug. 2015, the entire teachings of which are incorporated herein by reference.

TECHNICAL FIELD

The present invention relates to a paper feeding apparatus for feeding pasteboards such as cardboard sheets placed in a stacked manner toward a next-process device such as a printing device or a cutting device.

BACKGROUND ART

As this kind of paper feeding apparatus, there has been known one in which the lowermost one of multiple pasteboards placed in a stacked manner with the leading ends in contact with a reference plane of a guide plate that is provided over a paper feeding table with a clearance gap therebetween is sucked by a suction unit provided under the paper feeding table and, at the same time, fed by a paper feed roll with a portion of a peripheral surface thereof exposed through the paper feeding table intermittently one by one through the clearance gap of the guide plate toward a next-process device shown in Japanese Patent No. 2726516. The paper feed roll then includes ones provided at the stage prior to the guide plate (on the side with the pasteboards placed in a stacked manner) and respectively controlled by a single motor.

In this paper feeding apparatus, to feed the lowermost pasteboard sucked by the suction unit toward the next-process device, upper and lower feed rolls are provided at the stage subsequent to the guide plate (on the next-process device side) for feeding the pasteboard, which is fed by the paper feed rolls into the stage subsequent to the guide plate, through between the nips toward the next-process device. The paper feed rolls then undergo timing control during one cycle until the completion of feeding of the lowermost pasteboard in response to a timing signal from the next-process device.

Incidentally, in such a conventional paper feeding apparatus as described above in which multiple paper feed rolls are respectively controlled by a single motor, the motor is required to be accelerated rapidly from a stopped state to a high rotational speed and then braked rapidly to be stopped during one cycle until the completion of feeding of the lowermost pasteboard. In this case, if the rate of feeding of the pasteboard by the paper feed rolls is increased (e.g., the rate of feeding of the pasteboard with a length of 1100 mm in the feeding direction is 300 sheets/min or higher), the motor cannot be controlled without delay. This is because an operating time (e.g. 100 msec) is required for both of a clutch for power-on/off between the motor and each paper feed roll and a brake for braking each paper feed roll after disengagement of the clutch. Accordingly, since the time required for feeding of the lowermost pasteboard is as short as 200 msec at a rate of feeding of 300 sheets/min or higher, it is obviously and physically impossible to accelerate the motor rapidly from a state where the lowermost pasteboard is stopped to a high rotational speed and then stop it rapidly within the remaining 100 msec, which is a result of subtraction of the operating time for the clutch and the brake.

In view of this, it is conceivable that the paper feed rolls might be configured to be movable up and down through, for example, driving of a link mechanism, driven constantly at their respective highest rotational speeds, and brought into contact/non-contact with the lowermost pasteboard through an up-and-down movement of the link mechanism during one cycle until the completion of feeding of the pasteboard to increase the rate of feeding of the pasteboard by the paper feed rolls.

However, since the paper feed rolls are arranged at regular intervals in the direction of feeding of the lowermost pasteboard, the amount of feeding of the pasteboard is different for each of the paper feed rolls. This requires the paper feed rolls in the direction of feeding of the pasteboard to move independently up and down, resulting in a very complex structure.

The present invention has been made under these circumstances, and an object thereof is to provide a paper feeding apparatus that does not employ clutch and brake-based motor control to increase the rate of feeding of a pasteboard toward a next-process device with a simple structure even without an independent up-and-down movement of each paper feed roll.

SUMMARY OF THE INVENTION

In order to achieve the foregoing object, the present invention is on the basis of a paper feeding apparatus in which the lowermost one of multiple pasteboards placed in a stacked manner with the leading ends in contact with a reference plane of a guide plate that is provided at a position close to the rear portion of a paper feeding table with a clearance gap over the paper feeding table is sucked by a suction unit provided under the paper feeding table and, at the same time, fed by a paper feed roll with a portion of a peripheral surface thereof exposed through the paper feeding table intermittently one by one through the clearance gap of the guide plate toward a next-process device. Further, the paper feed roll includes ones provided via shafts in a width direction of the paper feeding table according to a size of the pasteboards in a width direction and a movement direction and arranged in multiple rows corresponding to the respective shafts followed by and following the guide plate, the rows being coupled to separate servomotors via the respective shafts. The servomotors are then controlled independently, and at least the servomotors just followed by and just following the guide plate are controlled so to be accelerated synchronously and rapidly from a stopped state to a high rotational speed, while controlled so to be decelerated from the high rotational speed to be stopped rapidly and respectively when the paper feed rolls in the rows coupled via the shafts to each of the servomotors are determined not to be in contact with the lowermost pasteboard.

According to the invention, the feeding of the lowermost pasteboard by the paper feed rolls in the respective rows can be controlled independently by the respective servomotors without employing clutch and brake-based motor control to increase the rate of feeding of the pasteboards toward the next-process device with a simple structure even without an independent up-and-down movement of each paper feed roll.

The servomotors followed by the servomotor just followed by the guide plate may also be controlled so to be accelerated rapidly from a stopped state to the high rotational speed, while controlled so to be decelerated from the high rotational speed to be stopped rapidly when the paper feed rolls coupled via the shafts to the servomotors are determined not to be in contact with the lowermost pasteboard.

According to the invention, the lowermost pasteboard can be fed by the paper feed rolls coupled via the shafts to the servomotors followed by the servomotor just followed by the guide plate, which allows the lowermost pasteboard to be fed efficiently in cooperation with the paper feed roll coupled via the shaft to the servomotor just followed by the guide plate. Further, the paper feed rolls coupled via the shafts to the servomotors are in a stopped state when in contact with the pasteboard following the lowermost pasteboard, which can reliably prevent the following pasteboard from being fed unintentionally.

The servomotors following the servomotor just following the guide plate may also be controlled so as to accelerate synchronously with the servomotor just followed by the guide plate and rapidly from a stopped state to the high rotational speed, while controlled so to be decelerated from the high rotational speed to be stopped rapidly when the paper feed rolls coupled via the shafts to the servomotors are determined not to be in contact with the lowermost pasteboard.

According to the invention, the lowermost pasteboard, which is fed into the stage subsequent to the guide plate, can be fed by the paper feed rolls coupled via the shafts to the servomotors following the servomotor just following the guide plate toward the next-process device, which allows the lowermost pasteboard, which is fed into the stage subsequent to the guide plate, to be fed efficiently toward the next-process device in cooperation with the servomotor just following the guide plate. Further, after feeding the lowermost pasteboard toward the next-process device, the servomotors can be stopped together with the servomotor just following the guide plate to prepare for the next cycle.

In contrast, the servomotors following the servomotor just following the guide plate may be controlled constantly to have the high rotational speed.

According to the invention, the servomotors can be controlled simply without control for each cycle from a stopped state through rapid acceleration to rapid stoppage as well as the lowermost pasteboard, which is fed into the stage subsequent to the guide plate, can be fed constantly efficiently toward the next-process device in cooperation with the servomotor just following the guide plate.

The servomotors may each include an encoder for independently measuring the amount of rotation and be controlled such that each paper feed roll is stopped rapidly with the determination not to be in contact with the lowermost pasteboard when the encoder measures that the amount of rotation required for feeding of the lowermost pasteboard by each servomotor is reached.

According to the invention, the encoder can independently measure the amount of rotation of each servomotor to determine more reliably that each paper feed roll is not in contact with the lowermost pasteboard.

Further, the suction unit may include ones provided independently at the stages prior to and subsequent to the guide plate, and the suction unit at the stage prior to the guide plate may be arranged to stop sucking when the time required for feeding the lowermost pasteboard toward the next-process device is 200 msec or shorter.

According to the invention, the suction resistance by the suction unit when the lowermost pasteboard is fed at a high speed of 200 msec or shorter can be eliminated, which allows the lowermost pasteboard to be fed smoothly by the paper feed rolls.

DESCRIPTION OF THE PREFERRED EMBODIMENTS

Paper feeding apparatuses according to embodiments of the present invention will hereinafter be described based on the accompanying drawings.

Figure 1:
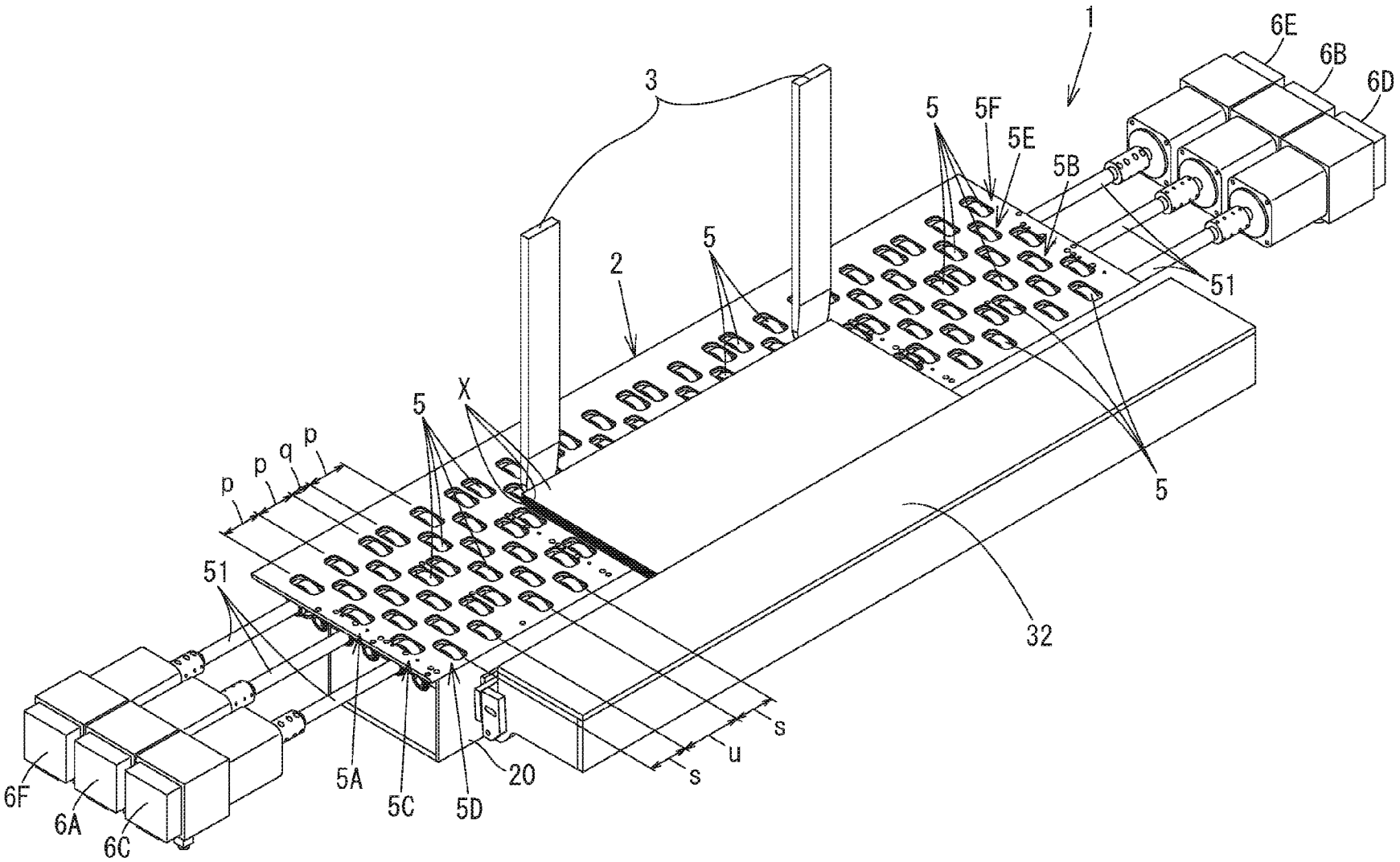
FIG. 1 is a perspective view showing the overall configuration of a paper feeding apparatus according to a first embodiment of the present invention.
Figure 2:
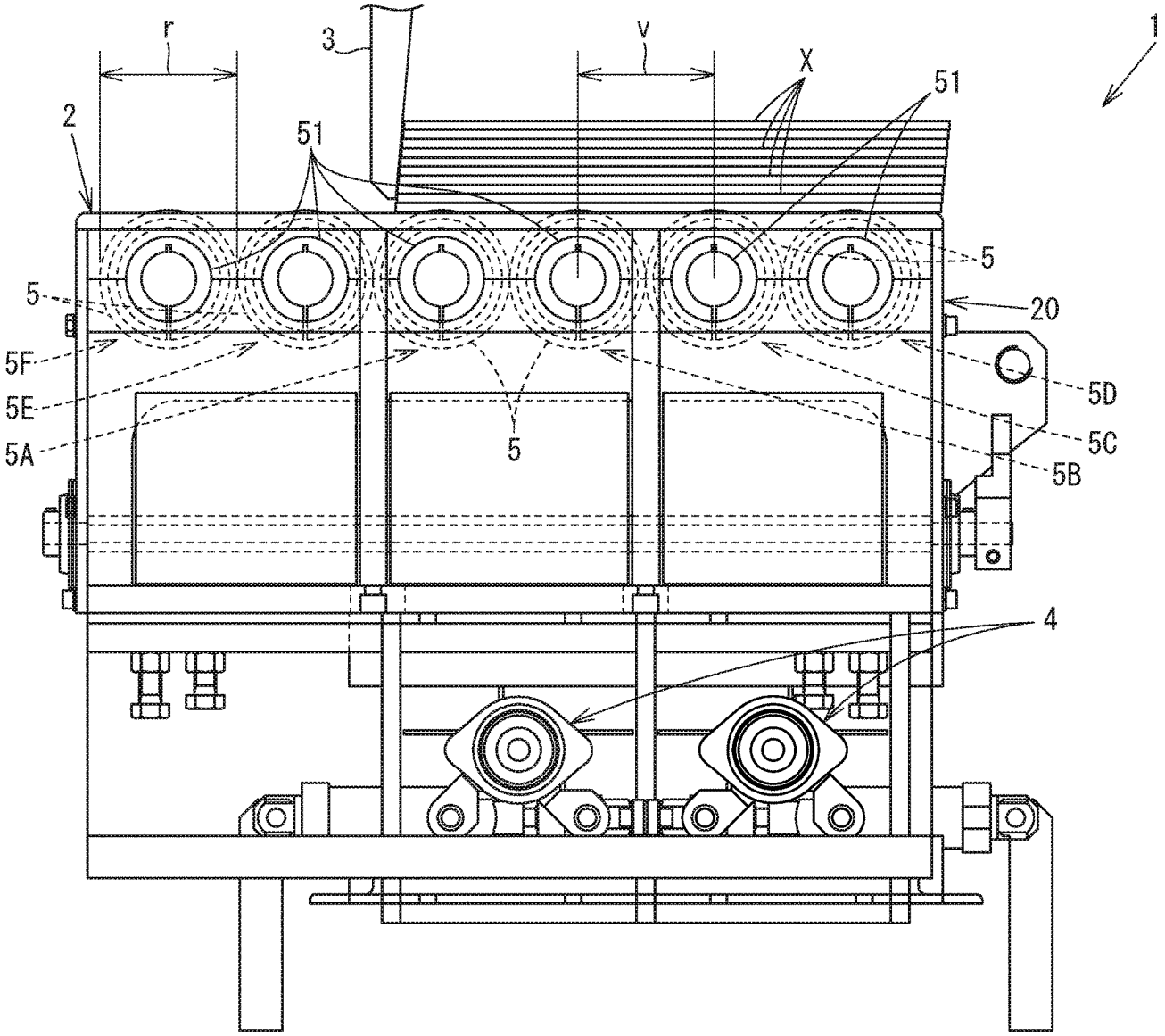
FIG. 2 is a side view of the paper feeding apparatus in FIG. 1.

FIG. 1 is a perspective view showing the overall configuration of a paper feeding apparatus according to a first embodiment of the present invention, and FIG. 2 is a side view of the paper feeding apparatus.

As shown in FIGS. 1 and 2, the paper feeding apparatus 1 is arranged to feed cardboard sheets X as pasteboards one by one toward a printing device Z (next-process device) of a carton former (not shown) for the next process and includes a paper feeding table 2 on which the multiple cardboard sheets X, X, . . . are placed in a stacked manner. The paper feeding table 2 is installed at the upper end of a housing 20. At a position close to the rear portion of the paper feeding table 2, a pair of left and right guide plates 3, 3 are provided with a clearance gap 31 over the paper feeding table 2 that corresponds to the thickness of a single cardboard sheet X. The guide plates 3, 3 each have a reference plane (the right-hand face in FIG. 2) with which the leading ends (the left ends in FIG. 2) of the multiple cardboard sheets X, X, . . . are in slidable contact and, between the reference plane and a back guide 32 provided at the front end of the paper feeding table 2, the cardboard sheets X are aligned in a layered manner. In this case, the lower end portion of each guide plate 3 is inclined with the lower portion located rearward (leftward in FIG. 2), with which the leading ends of the cardboard sheets X aligned in a layered manner are brought into linear contact with low friction and thereby prevented from getting caught on each guide plate 3.

Also, suction units 4, 4 for sucking the lowermost cardboard sheet X against the paper feeding table 2 are provided below the paper feeding table 2, that is, within the housing 20. The suction units 4, 4 are respectively housed in a front portion (right-hand portion in FIG. 2) of the housing 20 that corresponds to the stage prior to each guide plate 3 and arranged to suck downward the lowermost one of the cardboard sheets X aligned in a layered manner between the guide plates 3, 3 and the back guide 32. A suction unit (not shown) is provided also in a rear portion (left-hand portion in FIG. 2) of the housing 20 that corresponds to the stage subsequent to each guide plate 3 to suck downward the lowermost cardboard sheet X fed by paper feed rolls 5 to be described hereinafter into the stage subsequent to each guide plate 3 at the back of the paper feeding table 2 (at the stage subsequent to each guide plate 3).

Under the paper feeding table 2, multiple paper feed rolls 5, 5, . . . are provided at predetermined intervals via shafts 51 in the width (longitudinal) direction. These paper feed rolls 5, 5, . . . are formed to have the same shape and set to have a diameter "r" of 76 mm and a thickness of 25 mm in the direction of the shafts 51. Each paper feed roll 5, with a portion of a peripheral surface thereof exposed through the paper feeding table 2, is also arranged to come into contact with the lowermost cardboard sheet X on the paper feeding table 2 and thereby to feed the cardboard sheet X intermittently one by one through the clearance gap 31 of each guide plate 3 toward the printing device of the carton former. The paper feed rolls 5 are then arranged in six rows corresponding to the respective shafts 51 at regular intervals followed by and following each guide plate 3 to form first to sixth paper feed roll rows 5A to 5F coupled rotationally and integrally to the respective shafts 51. The first to fourth paper feed roll rows 5A to 5D are arranged in order at a position just followed by each guide plate 3 and positions followed thereby, while the fifth and sixth paper feed roll rows 5E, 5F are arranged in order at a position just following each guide plate 3 and positions following it. The shafts 51 of the first to sixth paper feed roll rows 5A to 5F are supported rotatably on multiple bearings (not shown) that are provided in the housing 20. It is noted that while each paper feed roll 5 is set to have a diameter "r" of 76 mm and a thickness of 25 mm, the diameter and the thickness are not intended to be limited thereto, but only required to be set such that each paper feed roll 5 has a weight of 100 g or less to reduce the inertial force by each paper feed roll 5.

Since the first to sixth paper feed roll rows 5A to 5F are arranged in proximity to each other with the spacing "v" between adjacent ones of the shafts 51, 51 set to 75 mm, to avoid contact of the paper feed rolls 5 thereof with each other, the phases of the paper feed rolls 5 in adjacent ones of the paper feed roll rows are arranged to be different in the width direction (lateral direction) of the guide plates 3. Specifically, in the first, third, and sixth paper feed roll rows 5A, 5C, 5F, the spacing "p" between the thickness centers of adjacent ones of the paper feed rolls 5, 5 is basically set to 100 mm, in which two of the paper feed rolls 5, 5 with the spacing "q" between the thickness centers thereof set to 50 mm are also arranged alternately. On the other hand, in the second, fourth, and fifth paper feed roll rows 5B, 5D, 5E, the spacing "s" between the thickness centers of adjacent ones of the paper feed rolls 5, 5 is basically set to 100 mm so as to be positioned between adjacent ones of the paper feed rolls 5, 5 in the direction of the shafts 51 of the first, third, and sixth paper feed roll rows 5A, 5C, 5F, in which to avoid interference with the two paper feed rolls 5, 5 in the first, third, and sixth paper feed roll rows 5A, 5C, 5F with the spacing "q" between the thickness centers thereof set to 50 mm, two of the paper feed rolls 5, 5 with the spacing "u" between the thickness centers thereof set to 200 mm are also arranged alternately at sites corresponding to the two paper feed rolls 5, 5.

The first to sixth paper feed roll rows 5A to 5F are coupled to first to sixth separate servomotors 6A to 6F via the respective shafts 51. Since adjacent ones of the shafts 51, 51 are arranged in proximity to each other, the first to sixth servomotors 6A to 6F are divided into right and left groups, the shafts 51 of the servomotors 6A to 6F in each group being not adjacent to each other in the fore-and-aft direction. Specifically, the first, third, and sixth servomotors 6A, 6C, 6F are coupled to one end (the left end in FIG. 1) of the shafts 51 of the first, third, and sixth paper feed roll rows 5A, 5C, 5F, while the second, fourth, and fifth servomotors 6B, 6D, 6E are coupled to the other end (the right end in FIG. 1) of the shafts 51 of the second, fourth, and fifth paper feed roll rows 5B, 5D, 5E. In this case, the first to sixth servomotors 6A to 6F employ one with specifications that meet conditions including a rated power of 7 kW, a rated torque of 2.230 $e^{+1}$ Nm, a rated rotational speed of 3000 $min^{-1}$, and a rotor moment of inertia of 1.230 $e^{-3}$ $kgm^2$.

Figure 3:
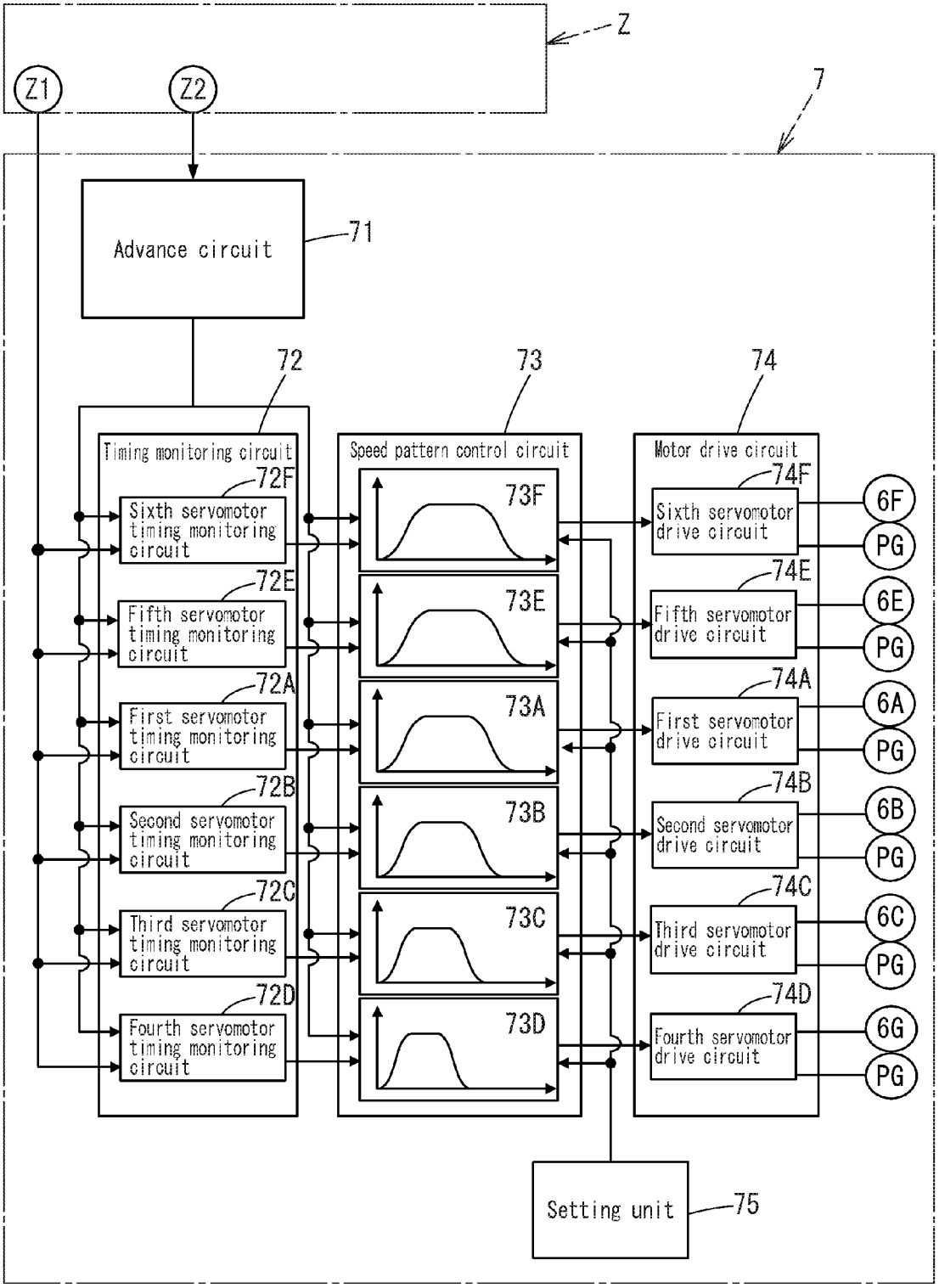
FIG. 3 is an illustrative view showing control details during one cycle by a controller of each servomotor of the paper feeding apparatus in FIG. 1.
Figure 4:
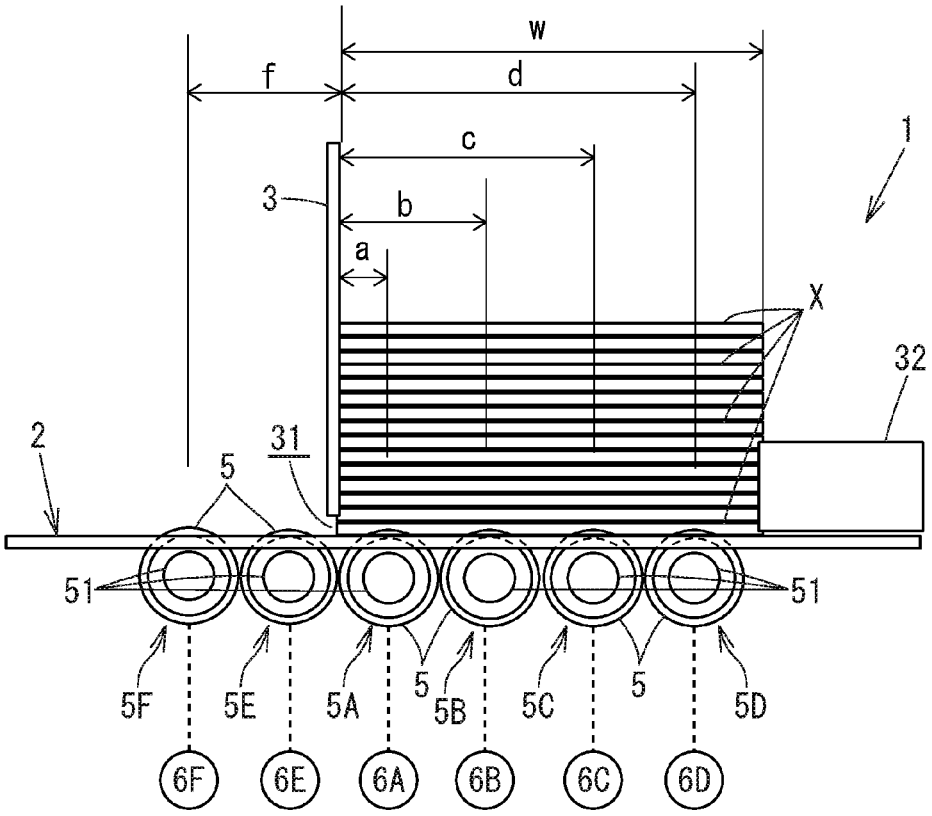
FIG. 4 is an illustrative view illustrating the amount of feeding of a pasteboard by paper feed rolls coupled via respective shafts to the respective servomotors of the paper feeding apparatus in FIG. 1.
Figure 5:
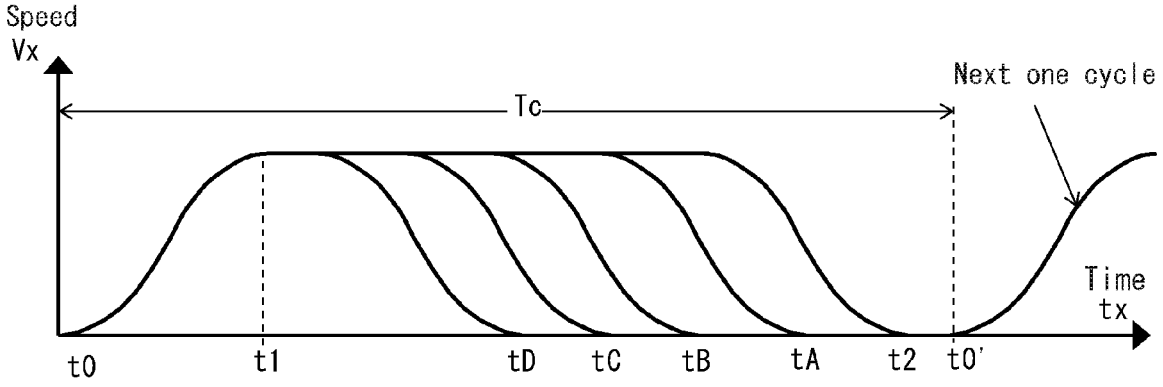
FIG. 5 is an illustrative view illustrating control timing during one cycle by each servomotor of the paper feeding apparatus in FIG. 1.

FIG. 3 is an illustrative view showing control details during one cycle by controllers of the servomotors 6A to 6F of the paper feeding apparatus 1, FIG. 4 is an illustrative view illustrating the amount of feeding of a cardboard sheet X by the paper feed rolls 5 coupled via the respective shafts 51 to the respective servomotors 6A to 6F of the paper feeding apparatus 1, and FIG. 5 is an illustrative view illustrating control timing during one cycle by the servomotors 6A to 6F of the paper feeding apparatus 1.

As shown in FIG. 3, the paper feed rolls 5 in the first to sixth paper feed roll rows 5A to 5F are controlled to be activated simultaneously by the first to sixth servomotors 6A to 6F to which the rolls are directly coupled via the respective shafts 51 based on a paper feeding command signal Z1 given synchronously with the cycle time of the printing device Z of the carton former (e.g. corresponding to a 360-degree roll of the print roll), accelerated rapidly to a high rotational speed equal to the circumferential speed of the print roll of the printing device Z until the leading end of the lowermost cardboard sheet X reaches the center of the shaft 51 of the sixth paper feed roll row 5F, rotated at the constant speed to a different deceleration starting position for each of the paper feed roll rows 5A to 5F, and then stopped rapidly. In this case, the paper feed rolls 5 in the first to sixth paper feed roll rows 5A to 5F are decelerated from the high rotational speed to be stopped rapidly and sequentially when determined not to be in contact with the lowermost cardboard sheet X during one cycle of the paper feeding apparatus 1 of feeding through contact with the lowermost cardboard sheet X.

Specifically, as shown in FIG. 4, the paper feed rolls 5 in the first to fourth paper feed roll rows 5A to 5D are arranged to be stopped rapidly and sequentially at, or shortly before, the time when the lengths of feeding (w−a, w−b, w−c, w−d) are reached that are obtained by subtracting the distances "a", "b", "c", "d" from the reference plane of each guide plate 3 (corresponding to the leading end of the lowermost cardboard sheet X before activation) to the shafts 51 of the first to fourth paper feed roll rows 5A to 5D, respectively, from the fore-and-aft length "w" of the lowermost cardboard sheet X. This is for the reason that even after the base end of the lowermost cardboard sheet X might have passed through the centers of the shafts 51 of the paper feed roll rows 5A to 5D, the rolls would continue rotating and come into contact with the next cardboard sheet X lying directly on the lowermost cardboard sheet X. In this case, the next cardboard sheet X, the leading end of which is in contact with each guide plate 3 and thereby inhibited from being fed by the paper feed rolls 5, could be scratched and/or deformed at the leading end portion through contact with the paper feed rolls 5.

On the other hand, the paper feed rolls 5 in the fifth and sixth paper feed roll rows 5E, 5F are arranged to be stopped rapidly at, or shortly before, the time when the length of feeding (w+f) is reached that is obtained by adding the distance "f" from the reference plane of each guide plate 3 to the shaft 51 of the sixth paper feed roll row 5F to the fore-and-aft length "w" of the lowermost cardboard sheet X.

While the one-cycle operation of the paper feeding apparatus 1 is repeated for each paper feeding command signal Z1 output from the printing device Z, the printing device Z cannot determine the activation timing of the first to sixth servomotors 6A to 6F to adapt the paper feed rolls 5 in the first to sixth paper feed roll rows 5A to 5F of the paper feeding apparatus 1 to one cycle (one roll) of the print roll of the printing device Z and thus has to output the paper feeding command signal at arbitrary timing. Accordingly, in the paper feeding apparatus 1, a timing monitoring circuit 72 within an electric control circuit 7 constantly monitors a paper feeding command signal Z1 synchronous with the cycle time of the printing device Z and a one-cycle signal Z2 of the print roll to accurately determine the activation timing of the first to sixth servomotors 6A to 6F.

The paper feeding command signal Z1 synchronous with the cycle time of the printing device Z and the one-cycle signal Z2 of the print roll are then output and sent to the timing monitoring circuit 72 to activate a speed pattern control circuit 73. That is, the paper feeding command signal Z1 and the one-cycle signal Z2 of the print roll are sent to first to sixth servomotor timing monitoring circuits 72A to 72F within the timing monitoring circuit 72 to activate first to sixth speed pattern control circuits 73A to 73F within the speed pattern control circuit 73. Based on settings from a setting unit 75 in which the fore-and-aft length "w" of each cardboard sheet X and the distances "a", "b", "c", "d", "f" from the leading end of the lowermost cardboard sheet X to the shafts 51 of the first to fourth and sixth paper feed roll rows 5A to 5D, 5F before activation are preset, the first to sixth speed pattern control circuits 73A to 73F compute speed patterns of the paper feed rolls 5 in the first to sixth paper feed roll rows 5A to 5F synchronous with the one-cycle operation of the print roll of the printing device Z to enable activation by the paper feeding command signal Z1 of the printing device Z and the one-cycle signal Z2 of the print roll. In this case, similar to the paper feed rolls 5 in the sixth paper feed roll row 5F, a speed pattern for the paper feed rolls 5 in the fifth paper feed roll row 5E is also computed, based on settings obtained by presetting the distance "f" from the leading end of the lowermost cardboard sheet X to the shaft 51 of the sixth paper feed roll row 5F before activation, to enable activation by the paper feeding command signal Z1 of the printing device Z and the one-cycle signal Z2 of the print roll.

In the case described above, the one-cycle signal Z2 of the print roll is sent to the first to sixth servomotor timing monitoring circuits 72A to 72F via an advance circuit 71. In the advance circuit 71, the activation timing of the paper feed rolls 5 in the first to sixth paper feed roll rows 5A to 5F is adjusted case by case according to the circumferential speed of the print roll of the printing device Z.

The one-cycle signal Z2 of the print roll is also sent to the first to sixth speed pattern control circuits 73A to 73F via the advance circuit 71. In the first to sixth speed pattern control circuits 73A to 73F, the one-cycle requisite time tx from activation time t0 to one-cycle completion time t2 is calculated based on the one-cycle signal Z2 of the print roll, speed patterns of the first to sixth speed pattern control circuits 73A to 73F are selected from those prepared based on the calculated one-cycle requisite time tx, and the amount of feeding of the lowermost cardboard sheet X by the paper feed rolls 5 in the first to sixth paper feed roll rows 5A to 5F is calculated from the one-cycle requisite time tx of the paper feeding apparatus 1.

In the first to sixth speed pattern control circuits 73A to 73F, since the print roll of the printing device Z is not necessarily driven constantly at an expected circumferential speed, the first to sixth servomotors 6A to 6F are feedforward controlled to cause the one-cycle requisite time tx of the paper feeding apparatus 1 to follow the one-cycle requisite time of the print roll relative to the one-cycle signal Z2 of the print roll. In this one cycle of the paper feeding apparatus 1, the paper feed rolls 5 in the first to sixth paper feed roll rows 5A to 5F reach a high rotational speed at time t1 after the activation, which, at that time, is equal to the circumferential speed of the print roll of the printing device Z. After the equalization to the circumferential speed of the print roll of the printing device Z, that is, the synchronization with the print roll of the printing device Z, the one-cycle requisite time tx of the paper feeding apparatus 1 is continuously calculated by the first to sixth speed pattern control circuits 73A to 73F. In the speed pattern control circuit 73, the one-cycle requisite time tx is input to the speed patterns of the first to sixth speed pattern control circuits 73A to 73F to calculate the amount of rotation of the first to sixth servomotors 6A to 6F (the amount of rotation of each shaft 51). The amount of rotation of the first to sixth servomotors 6A to 6F is measured by encoders (not shown) provided in the respective servomotors 6A to 6F. The measured values from the encoders are then input, respectively, to the first to sixth speed pattern control circuits 73A to 73F to drive the first to sixth servomotors 6A to 6F via first to sixth servomotor drive circuits 74A to 74F within a motor drive circuit 74 and thereby to rotate the paper feed rolls 5 in the first to sixth paper feed roll rows 5A to 5F via the respective shafts 51 synchronously with the print roll of the printing device Z.

While the first to sixth servomotors 6A to 6F are thus controlled independently, the first to sixth servomotor timing monitoring circuits 72A to 72F within the timing monitoring circuit 72 monitor the same signals (the paper feeding command signal Z1 of the printing device Z and the one-cycle signal Z2 of the print roll) to result in the same activation timing.

While the speed of the paper feed rolls 5 in the first to sixth paper feed roll rows 5A to 5F is then equal to the circumferential speed of the print roll of the printing device Z after time t1, the first to sixth servomotors 6A to 6F are controlled independently such that the paper feed rolls 5 in the first to sixth paper feed roll rows 5A to 5F are decelerated from the high rotational speed to be stopped rapidly and sequentially with the determination that the paper feed rolls 5 in the first to fourth and sixth paper feed roll rows 5A to 5D, 5F are not in contact with the lowermost cardboard sheet X when the encoders measure that the amount of rotation of the first to fourth and sixth servomotors 6A to 6D, 6F is reached during one cycle of the paper feeding apparatus 1 that is calculated by inputting the one-cycle requisite time tx to the speed patterns of the first to sixth speed pattern control circuits 73A to 73F. In this case, the fifth servomotor 6E is controlled such that the paper feed roll 5 in the fifth paper feed roll row 5E is decelerated from the high rotational speed to be stopped rapidly and sequentially when the encoder measures that the amount of rotation of the sixth servomotor 6F is reached.

Also, as shown in FIG. 5, the paper feed rolls 5 in the first to sixth paper feed roll rows 5A to 5F are activated at time t0 and accelerated rapidly to the high rotational speed before reaching time t1, which is equal to the circumferential speed of the print roll of the printing device Z. The distance obtained by integrating the speed curve from time t0 to time t1 is then set to be equal to the distance "f" from the leading end of the lowermost cardboard sheet X to the center of the shaft 51 of the sixth paper feed roll 5F before activation. Since it is necessary for the paper feed rolls 5 in the first to sixth paper feed roll rows 5A to 5F to be stopped before the start time t0' of the next cycle to transfer the cardboard sheets X intermittently one by one to the print roll of the printing device Z, the one-cycle completion time t2 of the paper feeding apparatus 1 is set before the start time t0' of the next cycle.

When the paper feed rolls 5 in the first to sixth paper feed roll rows 5A to 5F are activated, pulses from pulse generators PG accompanying the respective first to sixth servomotors 6A to 6F are fed back to the first to sixth servomotor drive circuits 74A to 74F within the motor drive circuit 74 for feedback control, and thus the first to sixth servomotors 6A to 6F are controlled so as to follow the speed patterns prepared in the first to sixth speed pattern control circuits 73A to 73F. That is, the first to sixth servomotors 6A to 6F are controlled from the activation into rapid acceleration, synchronization (constant speed), and rapid stoppage according to the speed patterns of the respective first to sixth speed pattern control circuits 73A to 73F.

In the speed pattern control circuit 73, the speed patterns of the respective first to sixth speed pattern control circuits 73A to 73F are stored to control the first to sixth servomotors 6A to 6F into rapid acceleration, synchronization, and rapid stoppage. Also, in the first to sixth speed pattern control circuits 73A to 73F, the one-cycle requisite time tx from activation time t0 to one-cycle completion time t2 is calculated based on the one-cycle signal Z2 of the print roll of the printing device Z and the requisite time tx is input to the speed patterns of the first to sixth speed pattern control circuits 73A to 73F to output the amount of rotation of the first to sixth servomotors 6A to 6F, whereby the paper feed rolls 5 in the first to sixth paper feed roll rows 5A to 5F are controlled with a synchronous position command during one cycle of the print roll of the printing device Z.

The speed patterns of the first to sixth servomotor speed pattern control circuits 73A to 73F to be activated by the first to sixth servomotor timing monitoring circuits 72A to 72F within the timing monitoring circuit 72 are then preset to zero at each activation of the first to sixth servomotors 6A to 6F, and the amount of rotation of the first to sixth servomotors 6A to 6F is also preset to zero. That is, in each cycle of the print roll of the printing device Z, the speed patterns of the first to sixth servomotor speed pattern control circuits 73A to 73F and the amount of rotation of the first to sixth servomotors 6A to 6F synchronized therewith are output repeatedly.

Figure 6:
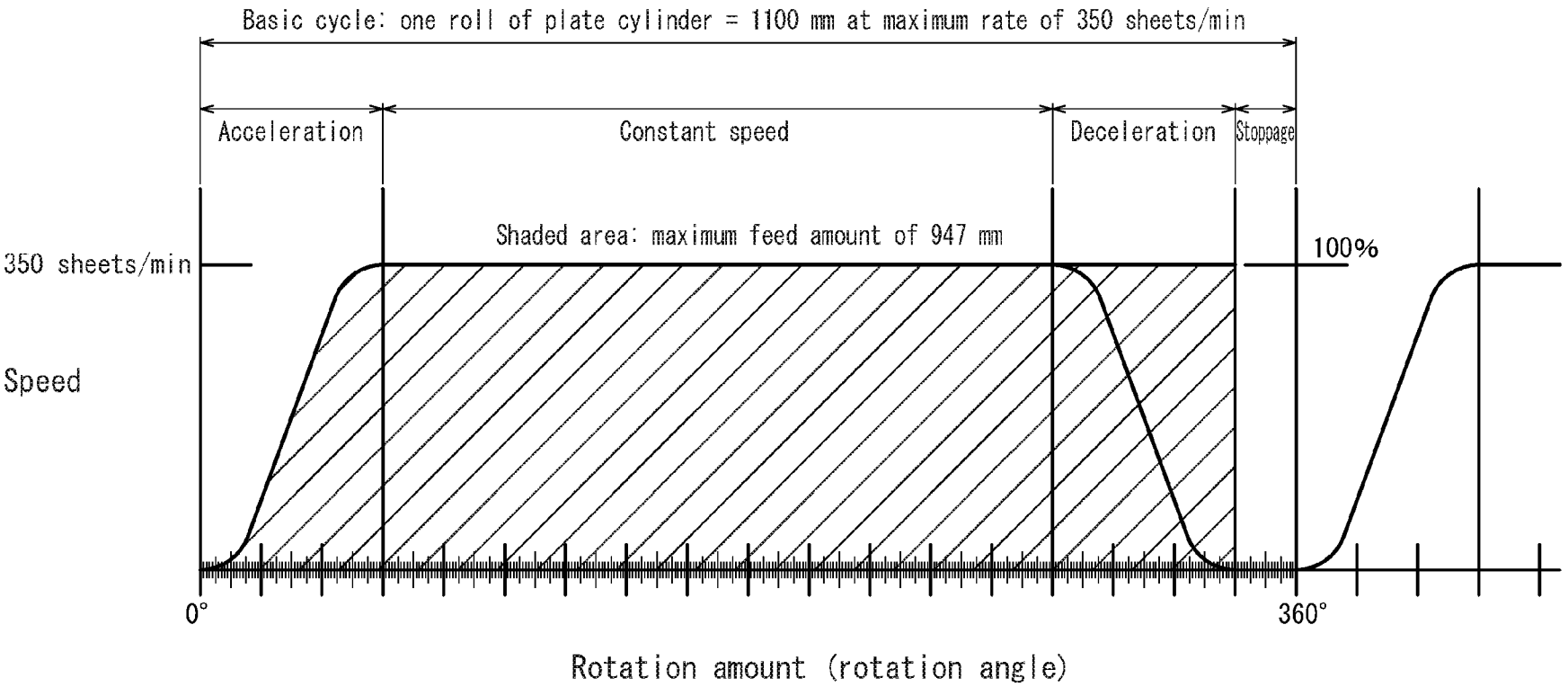
FIG. 6 is an illustrative view illustrating the amount of rotation of each servomotor during feeding of a cardboard sheet with a fore-and-aft length of 947 mm at a rate of 350 sheets/min.
Figure 7:
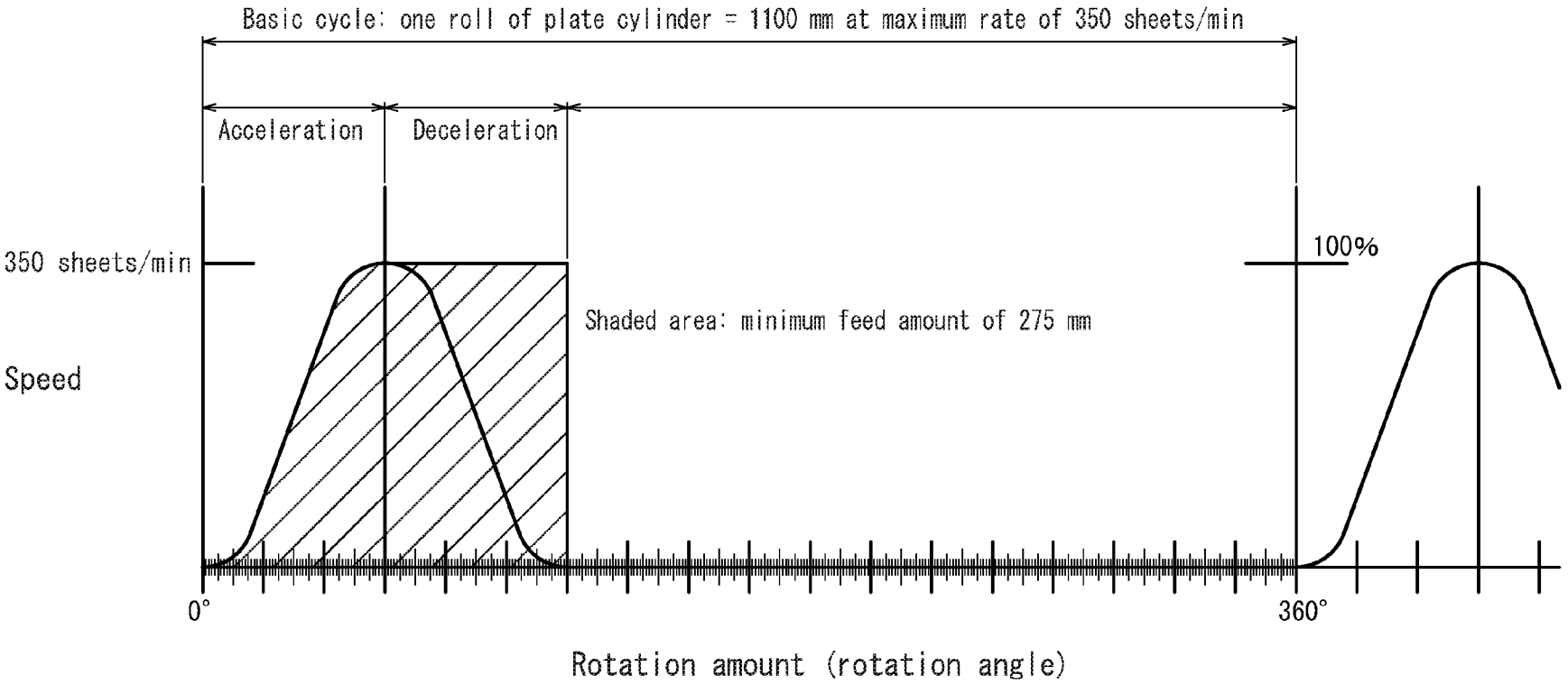
FIG. 7 is an illustrative view illustrating the amount of rotation of each servomotor during feeding of a cardboard sheet with a fore-and-aft length of 275 mm at a rate of 350 sheets/min.

An example of one-cycle control of the first to sixth servomotors 6A to 6F by the electric control circuit 7 will now be described. In this case, since the print roll of the printing device Z is set to have an outside diameter of 1100 mm, cardboard sheets X with a fore-and-aft length "w" of 947 mm are employed, which are to be fed toward the print roll of the printing device Z at a rate of 350 sheets/min. In this case, the amount of rotation of each servomotor when the cardboard sheets X with a fore-and-aft length "w" of 947 mm are fed at a rate of 350 sheets/min is approximately one roll (360 degrees) as shown in FIG. 6, while the amount of rotation of each servomotor when the cardboard sheets X with a fore-and-aft length "w" of 275 mm are fed at a rate of 350 sheets/min is approximately one third roll as shown in FIG. 7. At the rate of 350 sheets/min, the time required for one cycle of feeding the lowermost cardboard sheet X toward the print roll of the printing device Z is about 160 to 180 msec. Described here is the case in which cardboard sheets X with a fore-and-aft length "w" of 947 mm are fed at a rate of 350 sheets/min to clarify the amount of rotation of the servomotors 6A to 6F.

First of all, a paper feeding command signal Z1 synchronous with the cycle time of the printing device Z and a one-cycle signal Z2 of the print roll are output to the timing monitoring circuit 72 to activate the speed pattern control circuit 73. At this time, the paper feeding command signal Z1 and the one-cycle signal Z2 of the print roll are sent to the first to sixth servomotor timing monitoring circuits 72A to 72F within the timing monitoring circuit 72 to activate the first to sixth speed pattern control circuits 73A to 73F within the speed pattern control circuit 73. Also, the suction units 4 in the front portion of the housing 20 that corresponds to the stage prior to each guide plate 3 and the suction unit in the rear portion of the housing 20 that corresponds to the stage subsequent to each guide plate 3 are all active.

Next, based on settings from the setting unit 75 in which the fore-and-aft length "w" of each cardboard sheet X and the distances "a", "b", "c", "d", "f" from the leading end of the lowermost cardboard sheet X to the shafts 51 of the first to fourth and sixth paper feed roll rows 5A to 5D, 5F before activation are preset, the first to sixth speed pattern control circuits 73A to 73F compute speed patterns of the paper feed rolls 5 in the first to sixth paper feed roll rows 5A to 5F synchronous with the one-cycle operation of the print roll of the printing device Z and calculate one-cycle requisite time tx of the paper feeding apparatus 1, and the requisite time tx is then input to the speed patterns of the first to sixth speed pattern control circuits 73A to 73F to output the amount of rotation of the first to sixth servomotors 6A to 6F.

The first to sixth servomotors 6A to 6F are then activated according to the speed patterns of the first to sixth speed pattern control circuits 73A to 73F and accelerated rapidly before time t1 to a maximum rotational speed synchronous with the one-cycle operation of the print roll of the printing device Z to be equal to the circumferential speed of the print roll of the printing device Z, and thereafter rotated at a speed equal to the circumferential speed of the print roll of the printing device Z.

The first to sixth servomotors 6A to 6F are then controlled independently such that the paper feed rolls 5 in the first to sixth paper feed roll rows 5A to 5F are decelerated from the high rotational speed to be stopped rapidly and sequentially with the determination that the paper feed rolls 5 in the first to fourth and sixth paper feed roll rows 5A to 5D, 5F are not in contact with the lowermost cardboard sheet X when the encoders measure that the amount of rotation of the first to fourth and sixth servomotors 6A to 6D, 6F is reached that is calculated by inputting the one-cycle requisite time tx to the speed patterns of the first to sixth speed pattern control circuits 73A to 73F.

Specifically, the fourth servomotor 6D, which has a longest distance from the leading end of the lowermost cardboard sheet X to the shaft 51 of the fourth paper feed roll row 5D before activation, is controlled such that the paper feed roll 5 in the fourth paper feed roll row 5D is decelerated from the high rotational speed to be stopped rapidly and sequentially with the determination that the paper feed roll 5 in the fourth paper feed roll row 5D is not in contact with the lowermost cardboard sheet X when the encoder measures that the amount of rotation of the fourth servomotor 6D is reached. Subsequently, the third to first servomotors 6C to 6A, the distance of which from the leading end of the lowermost cardboard sheet X to the shafts 51 of the third to first paper feed roll rows 5C to 5A before activation is longer in this order, are controlled such that the paper feed rolls 5 in the third to first paper feed roll rows 5C to 5A are decelerated from the high rotational speed to be stopped rapidly and sequentially with the sequential determination that the paper feed rolls 5 in the third to first paper feed roll rows 5C to 5A are not in contact with the lowermost cardboard sheet X each time the encoders measure that the amount of rotation of the third to first servomotors 6C to 6A is reached. The fifth and sixth servomotors 6E, 6F are also controlled such that the paper feed rolls 5 in the fifth and sixth paper feed roll rows 5E, 5F are decelerated from the high rotational speed to be stopped rapidly and simultaneously with the determination that the paper feed roll 5 in the sixth paper feed roll row 5F is not in contact with the lowermost cardboard sheet X when the encoder measures that the amount of rotation of the sixth servomotor 6F is reached.

Also in the following cycles, repeatedly, speed patterns of the paper feed rolls 5 in the first to sixth paper feed roll rows 5A to 5F synchronous with the one-cycle operation of the print roll of the printing device Z are computed and one-cycle requisite time tx of the paper feeding apparatus 1 is calculated, and the requisite time tx is then input to the speed patterns of the first to sixth speed pattern control circuits 73A to 73F to output the amount of rotation of the first to sixth servomotors 6A to 6F, and thereafter the first to sixth servomotors 6A to 6F are controlled such that the paper feed rolls 5 in the first to sixth paper feed roll rows 5A to 5F are decelerated from the high rotational speed to be stopped rapidly and sequentially according to the amount of rotation of the first to sixth servomotors 6A to 6F.

Accordingly, in this embodiment, the multiple paper feed rolls 5 provided via the shafts 51 in the width direction of the paper feeding table 2 according to the size of the lowermost cardboard sheet X in the width direction and the movement direction are arranged in six rows corresponding to the respective shafts 51 at regular intervals followed by and following each guide plate 3 to form first to sixth paper feed roll rows 5A to 5F coupled rotationally and integrally to the respective shafts 51 and the first to sixth separate servomotors 6A to 6F to which the paper feed roll rows 5A to 5F are coupled via the respective shafts 51 are controlled independently, in which the first to sixth servomotors 6A to 6F are controlled such that the paper feed rolls 5 in the first to sixth paper feed roll rows 5A to 5F are accelerated synchronously and rapidly from a stopped state to a high rotational speed during one cycle of feeding through contact with the lowermost cardboard sheet X, while controlled such that during the one cycle, the paper feed rolls 5 in the first to sixth paper feed roll rows 5A to 5F are decelerated from the high rotational speed to be stopped rapidly and sequentially when determined not to be in contact with the lowermost cardboard sheet X, whereby the feeding of the lowermost cardboard sheet X by the paper feed rolls 5 in the first to sixth paper feed roll rows 5A to 5F can be controlled independently by the respective first to sixth servomotors 6A to 6F without employing clutch and brake-based motor control to increase the rate of feeding of the cardboard sheets X toward the print roll of the printing device Z with a simple structure even without an independent up-and-down movement of each paper feed roll.

Also, the servomotors 6A to 6F are controlled such that the paper feed rolls 5 in the first to sixth paper feed roll rows 5A to 5F are stopped rapidly and sequentially with the determination not to be in contact with the lowermost cardboard sheet X when the encoders measure that the amount of rotation of the first to sixth servomotors 6A to 6F is reached that is required for feeding of the lowermost cardboard sheet X by the paper feed rolls 5, whereby the encoders can independently measure the amount of rotation of the servomotors 6A to 6F to determine more reliably that the paper feed rolls 5 in the first to sixth paper feed roll rows 5A to 5F are not in contact with the lowermost cardboard sheet X.

Figure 8:
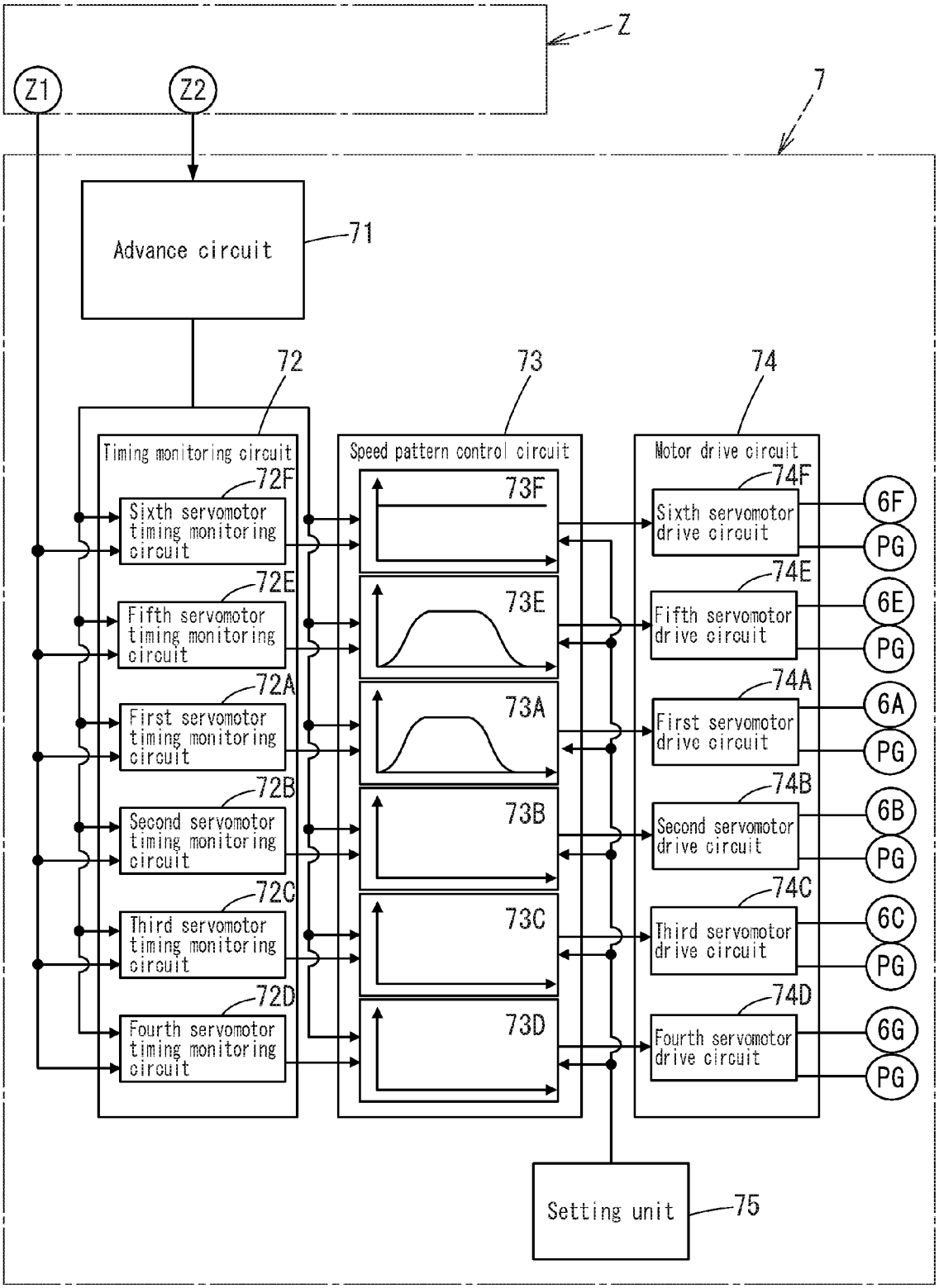
FIG. 8 is an illustrative view showing control details during one cycle by a controller of each servomotor of a paper feeding apparatus according to a second embodiment of the present invention.

A second embodiment of the present invention will next be described based on FIG. 8.

In this embodiment, the speed patterns of the second to fourth and sixth speed pattern control circuits 73B to 73D, 73F within the speed pattern control circuit 73 are modified. It is noted that the arrangements other than the speed patterns of the second to fourth and sixth speed pattern control circuits 73B to 73D, 73F are the same as those in the first embodiment, and therefore identical components are designated by the same reference signs to omit the detailed description thereof.

That is, in this embodiment, speed patterns of the paper feed rolls 5 in the first, fifth, and sixth paper feed roll rows 5A, 5E, 5F synchronous with the one-cycle operation of the print roll of the printing device Z are computed and one-cycle requisite time tx of the paper feeding apparatus 1 is calculated, and the requisite time tx is then input to the speed patterns of the first, fifth, and sixth speed pattern control circuits 73A, 73E, 73F to only output the amount of rotation of the first, fifth, and sixth servomotors 6A, 6E, 6F. In this case, the second to fourth servomotors 6B to 6D are in a freely rollable state to roll along with the feeding of the lowermost cardboard sheet X.

In addition, the suction units 4, 4 are inactive, so that the lowermost cardboard sheet X is not sucked at the stage prior to each guide plate 3, but only sucked by the suction unit at the stage subsequent to each guide plate 3.

Accordingly, in this embodiment, only the first and fifth servomotors 6A, 6E are required to be controlled by the electric control circuit 7 for each cycle of the paper feeding apparatus 1 so that the sixth servomotor 6F may be rotated constantly at a maximum rotational speed, which allows the control to be simplified.

It is noted that the present invention is not limited to the above-described embodiments, but may include various other modifications. For example, although in the above-described embodiments, the paper feed rolls 5 are formed into six rows, that is, the first to sixth paper feed roll rows 5A to 5F arranged at regular intervals in the fore-and-aft direction and coupled rotationally and integrally to the respective shafts 51, the number of paper feed roll rows is not limited to six, and less than six or seven or more paper feed roll rows may be used.

Although in the above-described embodiments, the printing device Z is employed as the next-process device, a cutting device for cutting cardboard sheets may, for example, be arranged as the next-process device.

Although in the above-described embodiments, the servomotors 6A to 6F are stopped rapidly with the determination that the paper feed rolls 5 in the first to sixth paper feed roll rows 5A to 5F are not in contact with the lowermost cardboard sheet X when the encoders measure that the amount of rotation required for feeding of the lowermost cardboard sheet X by the servomotors 6A to 6F is reached that is calculated using the one-cycle requisite time tx for feeding toward the printing device Z, speed patterns of the paper feed rolls in the paper feed roll rows synchronous with the one-cycle operation of the print roll of the printing device may be computed based on settings from the setting unit and, based on these speed patterns, the fore-and-aft length "w" of the cardboard sheets X, and the distances "a", "b", "c", "d", "f" from the leading end of the lowermost cardboard sheet X to the shafts of the first to fourth and sixth paper feed roll rows before activation, when the lengths of feeding (w−a, w−b, w−c, w−d) are reached that are obtained by subtracting the respective distances from the fore-and-aft length "w" of the lowermost cardboard sheet X, the servomotors may be stopped rapidly and sequentially with the determination that the base end of the lowermost cardboard sheet X has passed through the centers of the shafts of the paper feed roll rows.

Although in the above-described embodiments, the paper feeding apparatus 1 is described that feeds cardboard sheets X as pasteboards, not only a cardboard sheet but also anything may be fed as long as it is a pasteboard.

Further, although in the above-described embodiments, the first to sixth servomotors 6A to 6F employ one with specifications that meet conditions including a rated power of 7 kW, a rated torque of 2.230 $e^{+1}$ Nm, and a rotor moment of inertia of 1.230 $e^{-3}$ $kgm^2$, without limiting thereto, any servomotor may be employed as long as having specifications that meet conditions including a rated power of 7 kW or more, a rated torque of 2.230 $e^{+2}$ Nm or more, and a rotor moment of inertia of 1.230 $e^{-3}$ $kgm^2$ or less.

What is claimed is:

1. A paper feeding apparatus, comprising:

a paper feeding table on which a plurality of pasteboards are placed in a stacked manner;

a guide plate provided at a position closer to a first end of the paper feeding table than a second end of the paper feeding table with a clearance gap being provided between the guide plate and the paper feeding table, the guide plate having a reference plane in contact with a leading end of each of the plurality of pasteboards;

a plurality of paper feed rolls provided under the paper feeding table in a longitudinal direction of the paper feeding table, each of the plurality of paper feed rolls having a portion of a peripheral surface thereof exposed through the paper feeding table, and each of the plurality of paper feed rolls being arranged to come into contact with a lowermost pasteboard from among the plurality of pasteboards to intermittently feed the plurality of pasteboards one-by-one through the clearance gap of the guide plate toward a next-process device; and a suction unit provided under the paper feeding table for sucking the lowermost pasteboard against the paper feeding table at a same time that the plurality of pasteboards are intermittently fed one-by-one through the clearance gap of the guide plate by the plurality of paper feed rolls, wherein the plurality of paper feed rolls are respectively coupled to a plurality of servomotors, wherein each of the plurality of servomotors is controlled independently, and each of the plurality of servomotors includes an encoder for independently measuring an amount of rotation of the servomotor, wherein the plurality of servomotors includes (i) a first group of servomotors including servomotors between the first end of the paper feeding table and the guide plate and (ii) a second group of servomotors including servomotors between the second end of the paper feeding table and the guide plate, wherein the first group of servomotors and a servomotor closest to the guide plate from among the second group of servomotors are controlled to be synchronously accelerated from a stopped state to a maximum rotational speed during one cycle of feeding the lowermost pasteboard from among the plurality of pasteboards through the clearance gap of the guide plate toward the next-process device through contact with the plurality of paper feed rolls, wherein the servomotor closest to the guide plate from among the second group of servomotors is controlled to be decelerated from the maximum rotational speed to the stopped state when the amount of rotation measured by the encoder included in the servomotor closest to the guide plate from among the second group of servomotors reaches an amount of rotation required for feeding the lowermost pasteboard, and wherein the first group of servomotors are controlled to be decelerated from the maximum rotational speed to the stopped state when the amount of rotation measured by the encoder included in a servomotor closest to the first end of the paper feeding table reaches the amount of rotation required for feeding the lowermost pasteboard.

2. The paper feeding apparatus according to claim 1, wherein each of the second group of servomotors is controlled to be decelerated from the maximum rotational speed to the stopped state when the amount of rotation measured by the encoder included in the servomotor reaches an amount of rotation required for feeding the lowermost pasteboard.

3. A paper feeding apparatus, comprising:

a paper feeding table on which a plurality of pasteboards are placed in a stacked manner;

a guide plate provided at a position closer to a first end of the paper feeding table than a second end of the paper feeding table with a clearance gap being provided between the guide plate and the paper feeding table, the guide plate having a reference plane in contact with a leading end of each of the plurality of pasteboards;

a plurality of paper feed rolls provided under the paper feeding table in a longitudinal direction of the paper feeding table, each of the plurality of paper feed rolls having a portion of a peripheral surface thereof exposed through the paper feeding table, and each of the plurality of paper feed rolls being arranged to come into contact with a lowermost pasteboard from among the plurality of pasteboards to intermittently feed the plurality of pasteboards one-by-one through the clearance gap of the guide plate toward a next-process device; and a suction unit provided under the paper feeding table for sucking the lowermost pasteboard against the paper feeding table at a same time that the plurality of pasteboards are intermittently fed one-by-one through the clearance gap of the guide plate by the plurality of paper feed rolls, wherein the plurality of paper feed rolls are respectively coupled to a plurality of servomotors, wherein each of the plurality of servomotors is controlled independently, and each of the plurality of servomotors includes an encoder for independently measuring an amount of rotation of the servomotor, wherein the plurality of servomotors includes (i) a first group of servomotors including servomotors between the first end of the paper feeding table and the guide plate and (ii) a second group of servomotors including servomotors between the second end of the paper feeding table and the guide plate, wherein a servomotor closest to the guide plate from among the first group of servomotors and a servomotor closest to the guide plate from among the second group of servomotors are controlled to be synchronously accelerated from a stopped state to a maximum rotational speed during one cycle of feeding the lowermost pasteboard from among the plurality of pasteboards through the clearance gap of the guide plate toward the next-process device through contact with the plurality of paper feed rolls, wherein the servomotor closest to the guide plate from among the second group of servomotors is controlled to be decelerated from the maximum rotational speed to the stopped state when the amount of rotation measured by the encoder included in the servomotor closest to the guide plate from among the second group of servomotors reaches an amount of rotation required for feeding the lowermost pasteboard, wherein the servomotor closest to the guide plate from among the first group of servomotors is controlled to be decelerated from the maximum rotational speed to the stopped state when the amount of rotation measured by the encoder included in a servomotor closest to the first end of the paper feeding table reaches an amount of rotation required for feeding the lowermost pasteboard, and wherein a servomotor closest to the first end of the paper feeding table is controlled to constantly have the maximum rotational speed.

* * * * *